United States Patent [19]

Ihlenfield et al.

[11] Patent Number: 4,657,506

[45] Date of Patent: Apr. 14, 1987

[54] GAS BURNER

[75] Inventors: Harry Ihlenfield, Strongsville; George Warsack, Medina, both of Ohio

[73] Assignee: GlowCore Corporation, Cleveland, Ohio

[21] Appl. No.: 680,064

[22] Filed: Dec. 10, 1984

[51] Int. Cl.[4] ..... F23D 14/14

[52] U.S. Cl. ..... 431/329; 126/92 R; 431/170

[58] Field of Search ..... 431/326, 328, 329, 7, 431/170, 100; 126/92 R, 92 AC, 92 C, 92 B

[56] References Cited

U.S. PATENT DOCUMENTS

| | | | |
|---|---|---|---|
| 3,169,572 | 2/1965 | Constance et al. | 126/92 R |
| 3,202,205 | 8/1965 | Webster | 126/92 R |
| 3,204,683 | 9/1965 | Ruff et al. | 431/329 |
| 3,269,449 | 8/1966 | Witten | 431/328 |
| 3,975,140 | 8/1976 | Placek | 431/329 |
| 4,140,100 | 2/1979 | Ishihara | 126/92 B |
| 4,480,988 | 11/1984 | Okabayashi et al. | 431/329 |

FOREIGN PATENT DOCUMENTS

| | | | |
|---|---|---|---|
| 1362114 | 4/1962 | France | 431/329 |

*Primary Examiner*—Margaret A. Facarino

*Attorney, Agent, or Firm*—Woodling, Krost & Rust

[57] ABSTRACT

A burner construction which comprises a woven metal fabric supported on and surrounding a cylindrical metal support member which has openings along its length and around its periphery. A gas supply tube extends from an entrance end axially into the support member and forms an annular space therebetween. The gas supply tube is provided with openings in its periphery at the entrance end and is impervious at its periphery at the opposite. Gas enters the burner through the supply tube and into the annular space through the openings in the gas supply tube. Gas thereafter flows through the support member openings and through the woven metal fabric and is combusted at the outer surface of the metal fabric.

9 Claims, 8 Drawing Figures

GAS BURNER

The present invention relates in general to gas burners and particularly to such burners used in furnaces adapted to heat home and commercial structures.

The structure and operation of prior art burners for heating purposes are many and varied and cannot be adequately discussed herein. It can be said that the prior art burners work with varying degrees of efficiency and with varying advantages and disadvantages.

The primary object of the present invention is to overcome many of the deficiencies found in prior art burners of the type disclosed herein and is particularly to provide a burner with efficient combustion and a high B.T.U. output in relation to the burner size.

Other objects of the invention are to provide a burner that will handle a large range of fuel inputs and will not plug because of contaminators in the air supply.

Still further objects are to provide a burner which is relatively easy to manufacture, is sturdy in construction and which has a long working life. The materials of construction provide a burner whose surface will not substantially oxidize, which will have a relatively low surface temperature when functioning and which can be easily ignited when an electrical spark ignition is used.

Additional objects of the present invention are to provide a burner with ports of optimum size and configuration resulting in substantially even fuel flow with resultant even burning throughout the axial length of the burner.

Other objects and a fuller understanding of this invention may be had by referring to the following description and claims, taken in conjunction with the accompanying drawings, in which:

Figure 1:
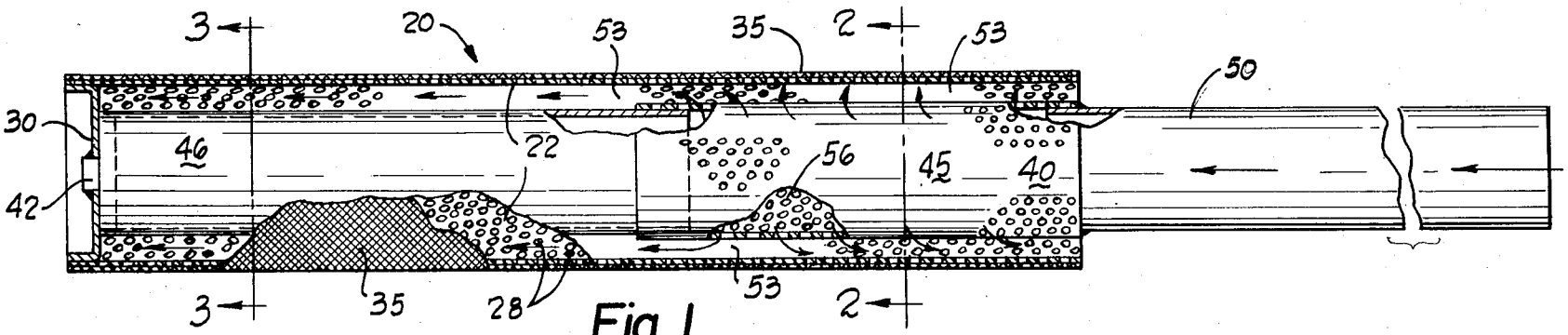
FIG. 1 is an elevational view, partially in section, illustrating the burner of the present invention.
Figure 4:
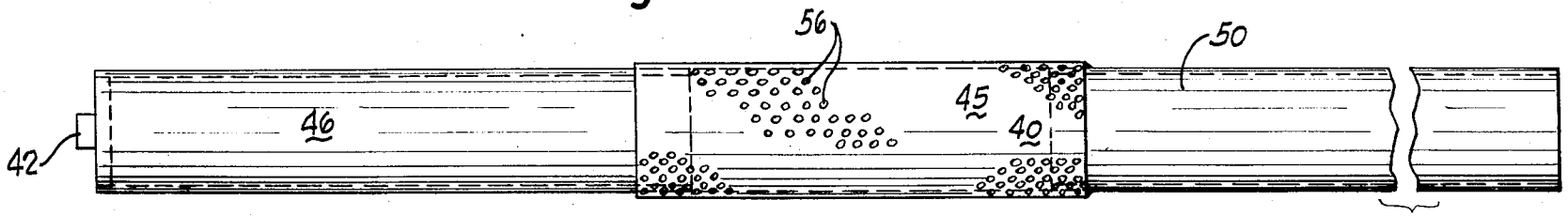
FIG. 4 is an elevational view of a portion of the burner structure of FIG. 1 and removed therefrom.
Figure 2:
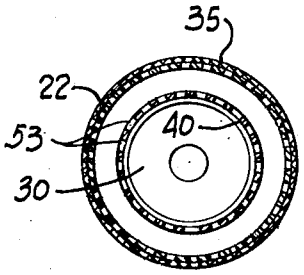
FIG. 2 is an enlarged view taken generally along the line 2—2 of FIG. 1.
Figure 3:
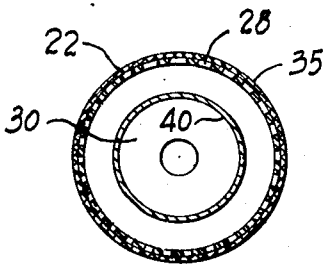
FIG. 3 is an enlarged view taken generally along the line 3—3 of FIG. 1.
Figure 5:
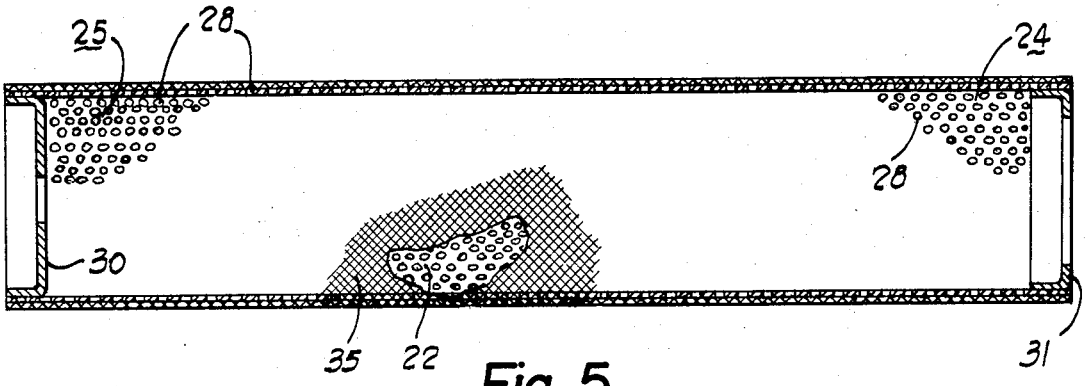
FIG. 5 is an elevational view of another portion of the burner structure of FIG. 1 and removed therefrom.
Figure 6:
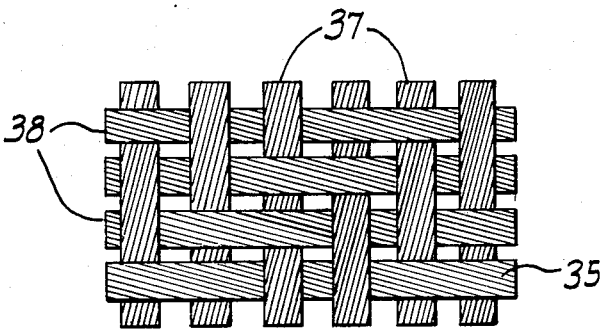
FIG. 6 is an enlarged plan view of the twilled dutch weave metal wire fabric used in the burner of the present invention.
Figure 7:
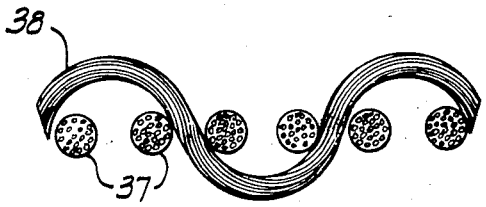
FIG. 7 is a cross-sectional view of the wire fabric of FIG. 6 showing the relationship of the shute and warp wires.
Figure 8:
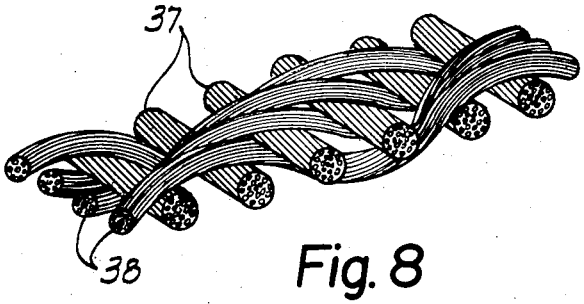
FIG. 8 is an isometric view of the wire fabric shown in FIGS. 6 and 7.

The burner 20 of the present invention as illustrated in the drawings includes a cylindrical metal support member 22 which has first and second end portions 24 and 25 respectively. Member 22 is preferably constructed of stainless steel. The member 22 as shown forms a hollow configuration and as manufactured has open opposed ends. The cylindrical member 22 is provided with a first multiplicity of small openings 28 which extend generally radially through member 22. The openings 28 shown herein are about 0.038" O.D. and there are about 400 of these openings per square inch. The openings 28 cover the entire axial and circumferential extent of member 22. A metal closure member 30 closes the open end of the hollow configuration at the second end portion 25 and a support member 31 is located in the opposite open end for a purpose to be later described.

A woven metal fabric 35 is carried by and surrounds the entire outer surface of the cylindrical support member 22 as shown in the drawings. The metal fabric is of stainless steel construction and is preferably a twilled dutch weave. The fabric may less desirably be a plain or twilled square weave or a plain dutch weave. The woven metal fabric preferably has openings of on the order of about 0.004" O.D. The fabric 35 and support and has on the order of from 650 to 70 openings per square inch. member 22 are secured to the periphery of the members 30 and 31 by welding.

A hollow gas supply tube 40 resides within and extends axially with respect to the hollow cylindrical support member 22. A button 42 on a second end portion 46 resides in an opening in closure member 30 and is welded thereto and a first end portion 45 resides within the bore of support member 31 to fix the position of the gas supply tube. An outboard portion 50 of the gas supply tube is appropriately connected to a combustible gas-air mixture supply.

The tube 40 forms an annular space 53 with the assembled member 22 and fabric 35 with the second end portion 46 of tube 40 being impervious and serving in effect as a plug member. The first end portion 45 of tube 40 is provided with openings 56 of the same type as openings 28, which provides for the entrance of the gas-air mixture from tube 40 to the annular space 53 which thereafter flows through openings 28 and through the openings in fabric 35 where it is combusted at the exterior surface of fabric 35. Openings 56 cover the entire first end portion 45.

This construction results in relatively even gas distribution along the entire axial extent of the burner periphery. The "plug effect" of the gas supply tube where it does not have radial openings with the resultant gas flow path as described appears to provide this described even gas distribution.

The following are some of the operating parameters of the burner of the present invention with the physical dimensions illustrated in the drawings and described hereinabove. Gas pressure in the range of from about 0.07 psi to 0.36 psi provide a natural gas flow and consumption of from about 25 to 120 cubic feet per hour with resultant heat produced in the range of from 25,000 to 120,000 BTUH. Air volume used usually amounts to 12 to 14 times the amount of natural gas.

It will thus be seen that the objects of the invention are economically and efficiently carried out. The burner is simple and rugged in construction and operates efficiently and with a long life.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A burner for burning mixtures of a gaseous combustible and air including in combination with an annularly shaped metal support member having first and second end portions, said support member being hollow and having a first multiplicity of small and radially extending openings therethrough, said first multiplicity of openings being arranged about the periphery and along the axial extent of said support member, a woven metal wire fabric surrounding and engaging the periphery of said support member, wall means closing said second end portions of said support member, a hollow gas supply tube having first and second end portions and extending into said support member through said first end portion thereof, said first and second end portions of said gas supply tube being secured respectivley to said first and second end portions of said support member, said gas supply tube and said support member defining an annular space therebetween, said first end portion of said gas supply tube having second multiplicity of small and radially extending openings therethrough, said second multiplicity of openings being arranged about the periphery and along the axial extent of said first end portion of said gas supply tube, said second end portion of said gas supply tube being substantially impervious to the passage of gas, introduction of a gaseous mixture under pressure to said gas supply tube causes the mixture to travel out of said second multiplicity of openings in said first end portion of said tube into said annular space and thereafter out said first multiplicity of openings in said support member and through said woven metal wire fabric where it may be combusted at the outer surface of said woven metal wire fabric.

2. A burner as claimed in claim 1 wherein said woven metal fabric has on the order of from 650 to 700 openings per square inch.

3. A burner as claimed in claim 2 wherein said openings are on the order of 0.004 inch in diameter.

4. A burner as claimed in claim 3 wherein said woven metal fabric is of a twilled dutch weave.

5. A burner for burning a gaseous combustible fuel including in combination a hollow generally cylindrically shaped metal member having first and second end portions, said cylindrically shaped member comprised of a woven metal fabric having a plurality of openings providing for the passage of a gas therethrough, conduit means providing for the entrance of gas into said first end portion of said hollow generally cylindrically shaped member, a cylindrical plug member extending axially from said second end portion of said hollow generally cylindrically shaped member toward said first end portion thereof and terminating intermediate said first and second end portions, said cylindrical plug member and said second end portion of said hollow generally cylindrically shaped member defining an annular space therebetween, introduction of gas under pressure into said first end portion of said hollow generally cylindrically shaped member through said conduit means causes the gas to flow in said annular space and out through said plurality of openings in said woven metal fabric.

6. A burner as claimed in claim 5 wherein said woven metal fabric has on the order of from 650 to 700 openings per square inch.

7. A burner as claimed in claim 6 wherein said openings are on the order of 0.004 inch in diameter.

8. A burner as claimed in claim 7 wherein said woven metal fabric is of a twilled dutch weave.

9. A burner as claimed in claim 5 wherein a cylindrically shaped support member engages on its outer surface and supports said cylindrically shaped member of woven metal fabric, said cylindrically shaped support member having a plurality of openings therethrough to provide for the passage of gas to said openings in said woven metal fabric.

* * * * *